United States Patent [19]

Menchetti et al.

[11] Patent Number: 4,901,485

[45] Date of Patent: Feb. 20, 1990

[54] ACOUSTICAL PANEL

[75] Inventors: Robert J. Menchetti, Buffalo; Andrew E. Heuer, Niagara Falls, both of N.Y.

[73] Assignee: National Gypsum Company, Dallas, Tex.

[21] Appl. No.: 334,039

[22] Filed: Apr. 6, 1989

[51] Int. Cl.[4] ..... E04B 1/82

[52] U.S. Cl. ..... 52/145; 52/823; 52/484; 181/291; 29/462

[58] Field of Search ..... 52/144, 145, 815, 823; 181/290, 291

[56] References Cited

U.S. PATENT DOCUMENTS

| | | | |
|---|---|---|---|
| 2,192,653 | 3/1940 | Schenk | 52/145 |
| 3,706,171 | 12/1972 | Shayman | 52/144 X |
| 3,712,846 | 1/1973 | Daniels et al. | 181/290 X |
| 4,194,329 | 3/1980 | Wendt | 52/145 |
| 4,283,891 | 8/1981 | Moeller | 52/144 |
| 4,291,783 | 9/1981 | Harris | 52/145 X |
| 4,423,573 | 1/1984 | Omholt et al. | 52/145 |
| 4,428,454 | 1/1984 | Capaul et al. | 52/144 X |

*Primary Examiner*—Carl D. Friedman

*Attorney, Agent, or Firm*—Laird F. Miller; Robert F. Hause

[57] ABSTRACT

An acoustical panel, for ceilings or for area separation, and the method of making such panels, wherein the panel consists essentially of a unitary frame consisting of four sides, each with an inwardly opening channel, an outwardly opening rebend and a downwardly extending flange, the panel further including a rigid gypsum board with edges filling the frame channel, a low density sound absorbing mat within the confines of the downwardly extending flanges, and a porous fabric facing concealing the acoustical mat and affixed to the frame by disposing the fabric edges in the outwardly opening rebends and crimping the rebends tightly closed.

16 Claims, 3 Drawing Sheets

ACOUSTICAL PANEL

BACKGROUND OF THE INVENTION

This invention relates of a novel acoustical panel having a rigid, high density backer board affixed within a thin gauge metal frame, with means on the frame holding the edges of a fabric facing which covers a low density sound absorbing mat between the fabric and the board.

U.S. Pat. No. 3,748,799 discloses a partition unit consisting of three elements, a rigid low density acoustical panel having a layer of suitable fabric on each of its two faces, and a plastic or metal frame enclosing the edges of the low density panel and its fabric facings.

U.S. Pat. No. 4,194,329 discloses a sound absorbing panel consisting of a sound absorbing material completely enclosed within a heat shrunk plastic material, supported by a frame extending about the outer edge of the enclosed sound absorbing material. A rigid, perforated facing can be placed on one or both faces of the enclosed sound absorbing material for support or protection, or a solid hard board backing can be placed on one face, all of these elements having their edges within the frame. The solid hard board could be placed between two units of enclosed sound absorbing material.

It is an object of the present invention to provide a novel acoustical panel in respect to the manner of combining the elements of the panel.

It is a further object of the invention to provide an acoustical panel which incorporates a relatively lighter weight, less expensive metal frame by the manner in which the frame is structurally completely supported by its channel portion being tightly engaged around the edges of a high density rigid board.

It is a further object of the invention to provide an acoustical panel having a lightweight metal frame which includes means for grasping and retaining the edges of a fabric facing, which fabric facing then encloses and retains a low density sound absorbing mat against the high density backer board.

BRIEF DESCRIPTION OF THE DRAWINGS

These and other objects and advantages will be more readily apparent when considered in relation to the preferred embodiments of the invention as set forth in the specification and shown in the drawings in which.

DESCRIPTION OF THE PREFERRED EMBODIMENTS

Figure 1:
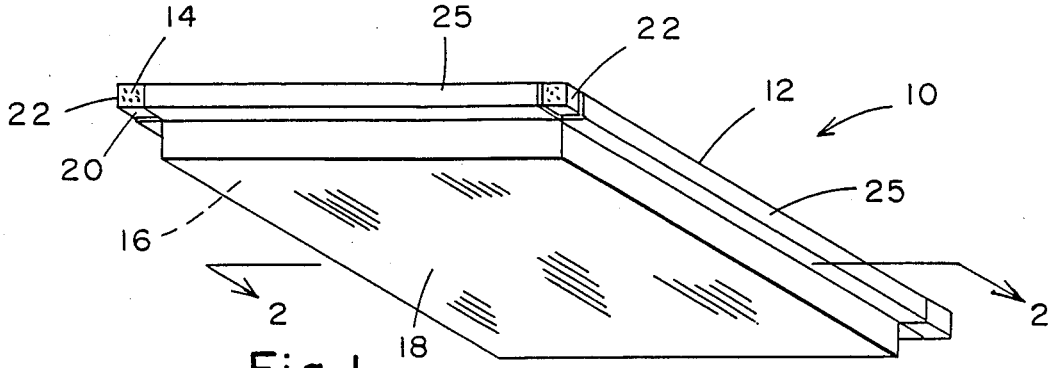
FIG. 1 is an isometric view of an acoustical panel made in accordance with the present invention.
Figure 2:
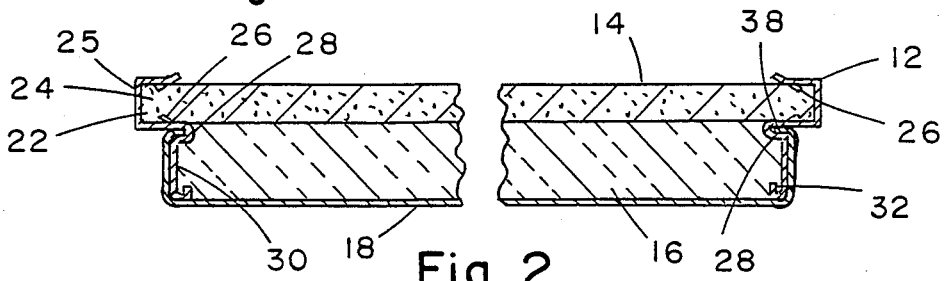
FIG. 2 is an end sectional view of the panel of FIG. 1 taken on line 2—2 thereof.

Referring to the drawings, there is shown an acoustical panel 10. Panel 10 consists of a light gauge sheet metal frame 12, a gypsum backer board 14, a low density fiber glass mat 16 and a porous fabric facing 18.

Figure 3:
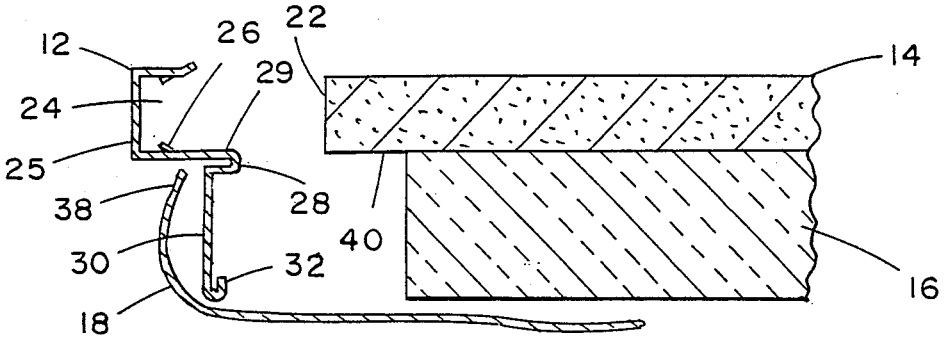
FIG. 3 is an enlarged view of the edge portion of the elements of FIG. 2 prior to their being assembled together, to illustrate the manner of their being assembled.

In FIG. 1, the gypsum backer board 14 will be seen to have exposed portions 20 at each corner of the panel 10. The gypsum backer board 14 has the four side edges 22 each inserted into an inwardly opening channel 24 in each of the four sides 25 of frame 12. In FIG. 3, the frame 12 will be seen to have locking barbs 26 in channels 24 which prevent the frame 12 from coming off of the edges 22 of the gypsum backer board 14. The gypsum backer board 14 is a paper covered, gypsum-core board of about $\frac{3}{8}$ inch to $\frac{5}{8}$ inch thickness.

Figure 4:
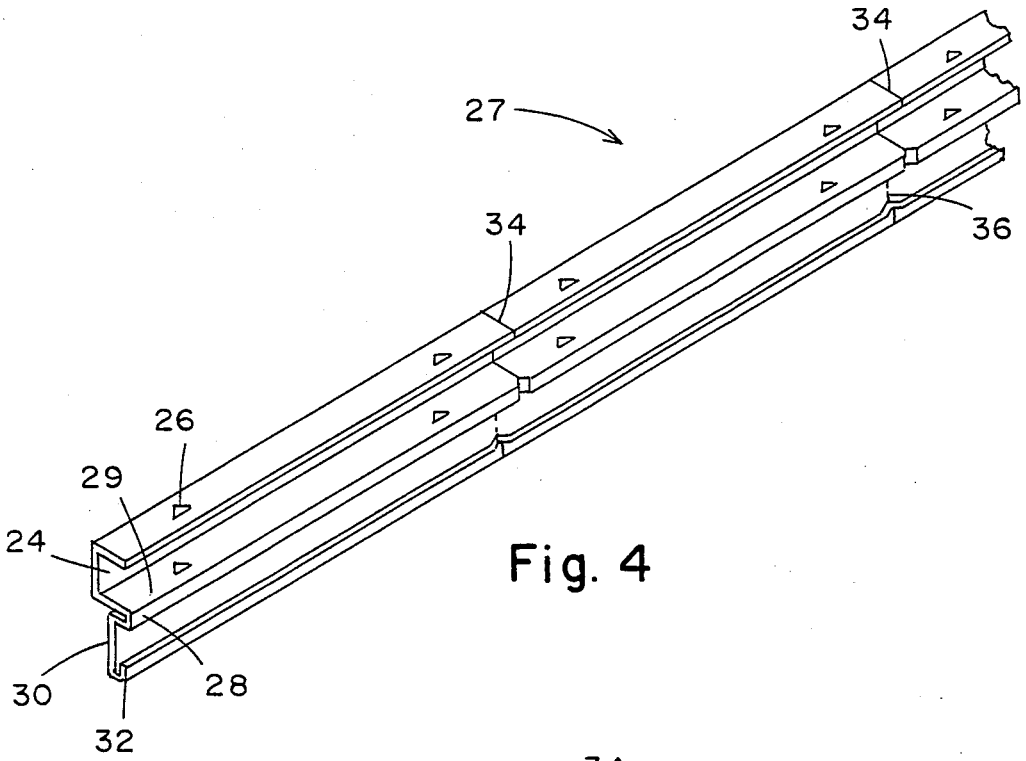
FIG. 4 is an isometric view of the elongate formed sheet metal frame element prior to final bending, showing shear lines and bend lines.
Figure 5:
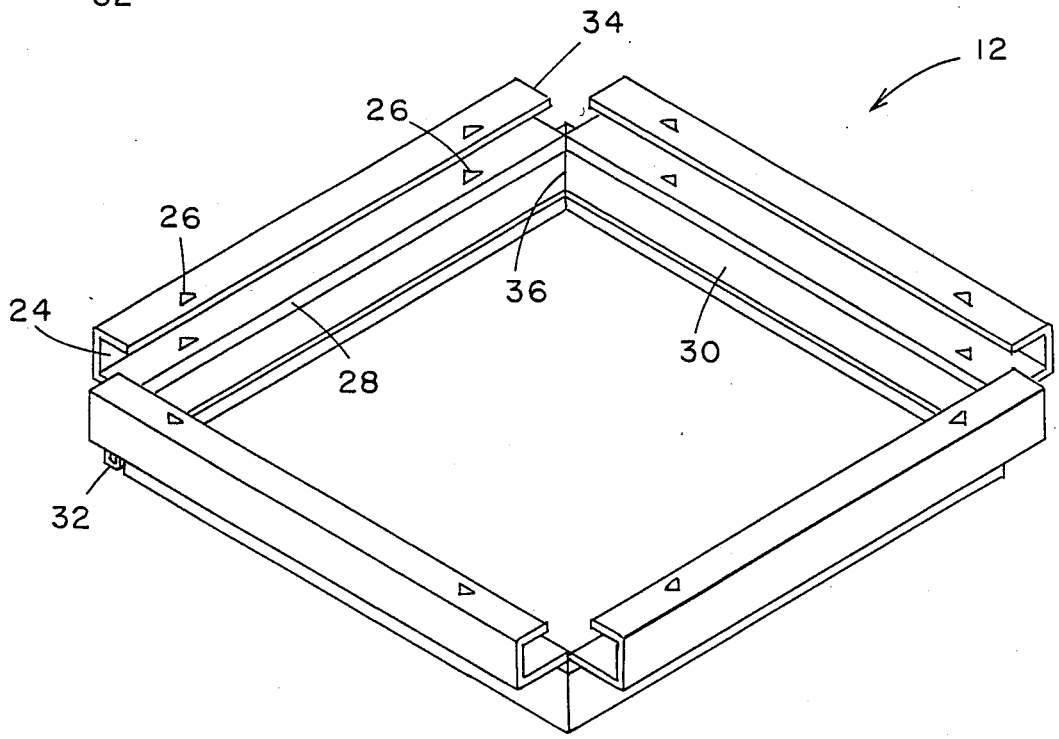
FIG. 5 is an isometric view of the formed sheet metal frame element of FIG. 4 after bending but prior to being combined with the backer board, the sound absorbing mat and the fabric.

The metal frame is shown in FIG. 4 and 5 to be originally an elongate roll-formed sheet metal element 27 having, along the top, the channel 24, an outwardly opening fabric retainer rebend 28 formed immediately below channel 24, and a downwardly extending flange 30 below the rebend 28, inward of the outer bottom 29 of channel 24. An upwardly turned hem 32 is formed along the bottom of flange 30. Element 27 is shown to have shear lines 34 at three spaced parallel positions whereat the channel portion 24 is totally severed, and indented bend lines 36 extending from the shear lines 34 across the rebend 28, the flange 30 and the hem 32.

Assembly of the panel will be seen to consist of the steps of folding the element 27 into the four-sided frame 12, along bend lines 36. Prior to completion of this bending step, the gypsum backer board edges 22 are pushed into the channels 24. Fiber glass mat 16 is then placed within the confines of the four flanges 30, and the fabric facing 18 is affixed over the surface of the mat 16 and around the outside of flanges 30. The four edges 38 of fabric facing 18 are inserted into the four rebends 28 of the four sides 25 of frame 12, and the four rebends 28 are crimped to a tightly rebent rebend 28, by pushing flanges 30 upward against the bottom side 40 of board 14.

The fabric facing 18 is caused to be stretched tightly across the face of the mat 16, as the edges 38 are being locked into the rebend 28. The fabric facing 18 conceals the mat 16 and the flanges 30 of the four sides 25.

The frame 12 is made of a light gauge sheet metal, preferably about 0.012 inch, galvanized steel, which is roll-formed to the cross-sectional shape described above for metal element 27. The light gauge metal is adequate for producing a structurally rigid, stable acoustical panel due to the combination of the frame 12 with a rigid gypsum backer board 14, with the gypsum backer board edges 22 completely filling the channels 24 of the four sides 25 of frame 12, and being locked into the channels by barbs 26.

It is contemplated that frame 12 could also be made of a low cost plastic extrusion, such as of rigid polyvinyl chloride, with shear lines 34 cut into the channel 24 and bend lines 36 formed in rebend 28, flange 30 and hem 32. A temporary heating of the polyvinyl chloride rebends 28 is necessary during attachment of the fabric edges 38 within the rebends 28.

In the embodiment shown, the four sides 25 are of equal length, forming a square panel 10 of about one to four feet on each side. It is contemplated that rectangular panels of, for example, two feet by four feet, can also be formed in accordance with the invention.

The gypsum backer board 14 can be replaced by any other equivalent rigid board, such as a fiber cement board, or a wood fiber board.

The fiber glass mat 16 can be replaced by any other equivalent low density sound absorbing material.

Figure 6:
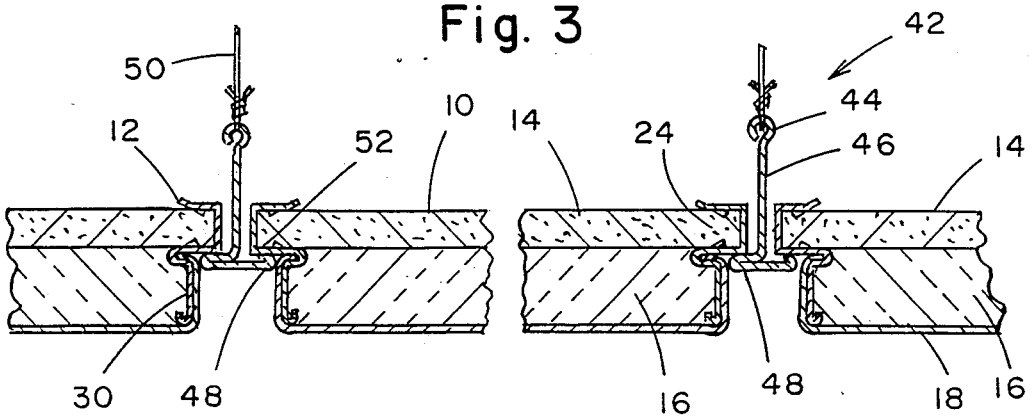
FIG. 6 is a sectional view of a ceiling consisting of a plurality of acoustical panels mounted on a suspended ceiling grid system.

Referring to FIG. 6, there is shown a suspended ceiling 42, with elongate ceiling grid T-runners 44 supporting the panels 10. T-runners 44 have an inverted-T cross section with a vertical web 46 and at the bottom thereof a pair of oppositely directed horizontal flanges 48. The channels 24 of frames 12 rest on top of the flanges 48. T-runners 44 are suspended from a building ceiling or ceiling framework (not shown) by wires 50 affixed to webs 46. The portion of panels 10 which is covered by fabric facing 18 is all that is visible of panel 10, from below, presenting an appearance of a downwardly protruding, box-like, spaced-apart plurality of ceiling panels. The channels 24 and the rigid board 14 therein, will be seen to have a greater area than the area of the confines of the flanges 30, forming a shoulder 52 which rests on the flanges 48.

Figure 7:
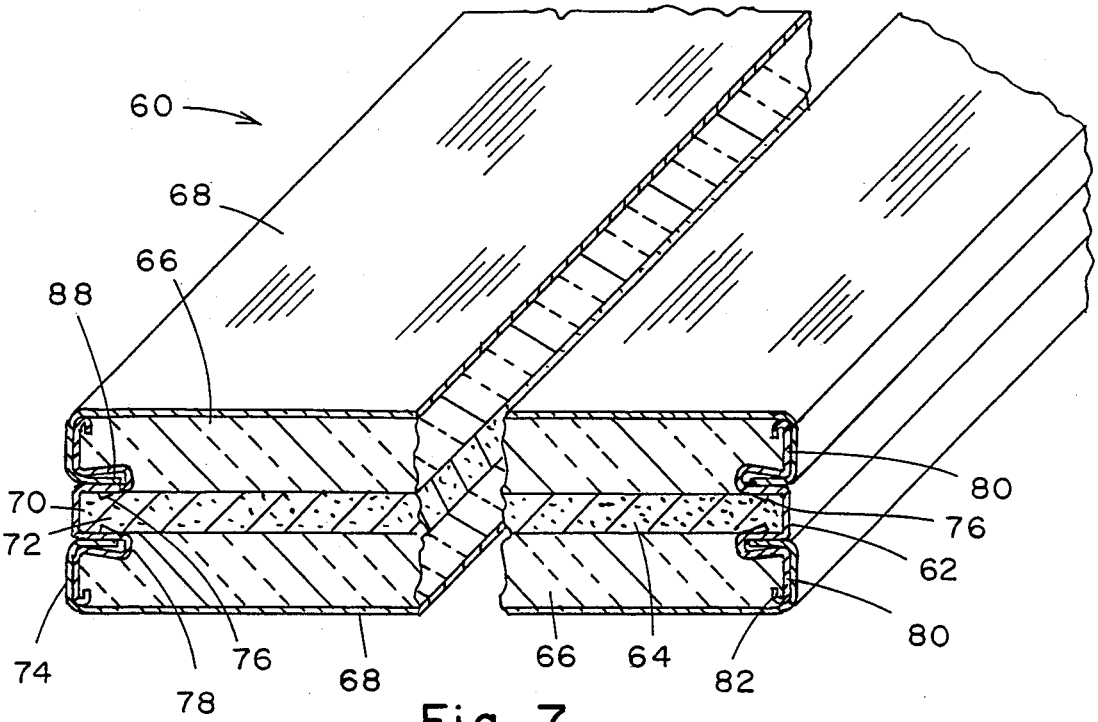
FIG. 7 is an isometric sectional end view of a modified form of the acoustical panel of the invention, with the backer board centered between two fabric enclosed sound absorbing mats.

A modification of the invention is shown in FIG. 7, wherein a two-sided acoustical panel 60 consists of a light gauge sheet metal frame 62, a gypsum center board 64, two low density fiber glass mats 66, 66 and two porous fabric facings 68, 68.

The gypsum center board 64 has four side edges 70 each inserted into an inwardly opening channel 72 in each of the four sides 74 of frame 62. The frame 62 will be seen to have locking barbs 76 in channels 72 which prevent the frame 62 from coming off the edges 70 of the gypsum center board 64.

The metal frame 62 is an elongate roll-formed sheet metal element having a central inwardly opening channel 72 with an outwardly opening fabric retainer rebend 78 formed along each side of channel 72. Extending upwardly and downwardly from respectively the upper and the lower rebends 78 are flanges 80. A reverse hem 82 is formed along the outer edge of each flange 80.

Figure 8:
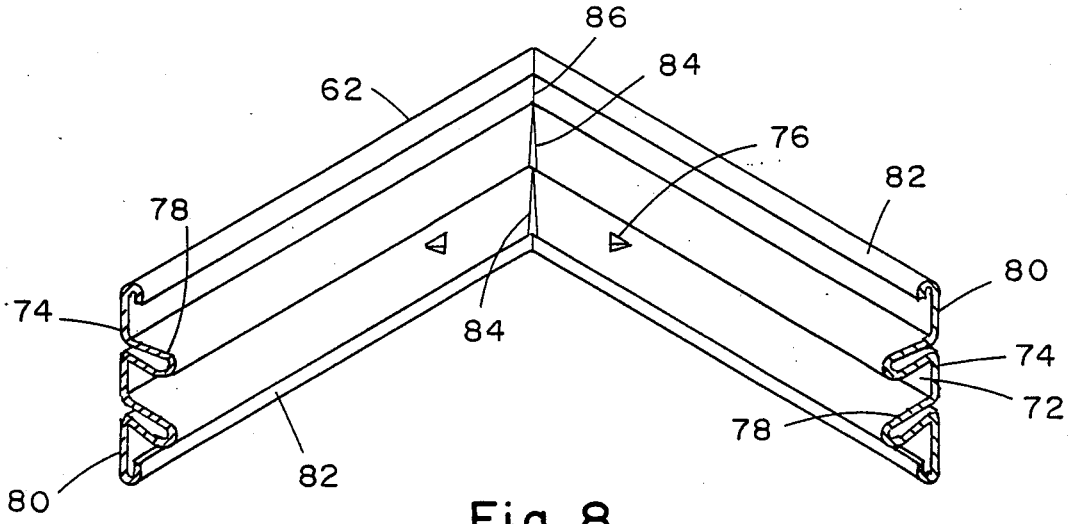
FIG. 8 is an isometric sectional view of a corner portion of the frame of the panel of FIG. 7.

In FIG. 8, the inwardly extending portions of channel 72 and rebends 78 will be seen to have mitered portions 84 removed at each corner to permit the frame 62 to be bent inward at each corner along bend lines 86.

Panel 60 is assembled in substantially the same way as panel 10, with the gypsum board edges 70 inserted and affixed into channels 72. The two fiber glass mats 66, 66 are placed within the confines of the two opposed flanges 80, 80 and the two fabric facings 68, 68 are affixed over the surfaces of the mats 66, 66 and around the outside of flanges 80, 80. The four edges 88 of each fabric facing 68, 68 are inserted into the respective rebends 78, 78 of the four sides 74 of frame 62, and the eight rebends 78 of the four sides 74 are crimped to a tightly rebent rebend 78, by pushing the opposed flanges 80, 80 together.

The two-sided panel 60 is constructed to provide a vertically disposed area separator with sound absorption provided relative to sound produced on both sides of the panel 60.

The gypsum backer board 14 of panel 10 and the gypsum center board 64 of panel 60 are both able to provide their respective panels with good sound transmission loss characteristics.

Having completed a detailed disclosure of the preferred embodiments of our invention, so that those skilled in the art may practice the same, we contemplate that variations may be made without departing from the essence of the invention.

We claim:

1. An acoustical panel comprising a thin unitary, four-sided frame, a rigid board, at least one low density sound absorbing mat and at least one porous fabric facing, said frame having in each of four sides an inwardly directed channel, said rigid board having four side edges, said four side edges being disposed within and substantially completely filling said frame channel, said frame having, in each side, at least one outwardly opening rebend adjacent said channel and a flange adjacent said rebend extending away from said channel, said flanges of said frame four sides forming a space therewithin wherein said low density mat is disposed, said fabric facing having four edges, said facing four edges being disposed and tightly held within said rebends of said frame four sides, said facing extending over said flanges and over said low density mat, retaining said low density mat within the confines of said four flanges.

2. An acoustical panel as defined in claim 1 wherein said panel consists essentially of only one unitary frame, only one rigid board, only one low density mat and only one porous fabric facing.

3. An acoustical panel as defined in claim 1 wherein said panel consists essentially of said frame, said rigid board, two low density mats and the two porous fabric facings.

4. An acoustical panel as defined in claim 1 wherein said frame is a continuous unitary element which has at least three corners formed by severing said channel and folding said flange.

5. An acoustical panel as defined in claim 1 wherein said frame is a unitary roll-formed light gauge sheet metal folded element.

6. An acoustical panel as defined in claim 1 wherein said frame is a unitary extruded plastic folded element.

7. An acoustical panel as defined in claim 1 wherein said rigid board is a paper covered gypsum board.

8. An acoustical panel as defined in claim 1 wherein said rigid board is about one foot to about four foot in length of each of four sides.

9. An acoustical panel as defined in claim 1 wherein said rigid board is about $\frac{3}{8}$ inch to $\frac{5}{8}$ inch thick.

10. An acoustical panel as defined in claim 1 wherein said rigid board is affixed within said frame channel by inwardly protruding the barbs formed in said frame channel.

11. An acoustical panel as defined in claim 1 wherein said confines formed by said four flanges has a substantially smaller area than the area of said rigid board, whereby said rigid board and said channels containing said edges of said rigid board form a shoulder extending beyond the confines of said flanges.

12. A suspended ceiling comprising a suspended grid system and acoustical panels as defined in claim 1, said grid system including inverted-T bars, said acoustical panels being supported on said inverted-T bars with said fabric facing forming an exposed bottom surface of said panels.

13. A suspended ceiling as defined in claim 12 wherein said rigid board and said channels containing said edges of said rigid board form a shoulder extending beyond the confines of said flanges, said shoulder being disposed on said inverted-T bar.

14. A habitable space normally having sound emanating from at least two sources, wherein a two-sided acoustical panel as defined in claim 3 is vertically disposed between said two sound sources with said two fabric facings directed respectively toward said two sound sources.

15. The method of making an acoustical panel comprising the steps of forming an elongate frame element with a sidewardly directed channel, an oppositely directed, sidewardly directed rebend immediately below said channel and a downwardly directed flange immediately below said rebend, severing said channel at at least three spaced positions along said elongate element and indenting a fold line across said flange below said severance of said channel, forming a 90° fold at said fold lines to form a four-sided frame, with said channel opening inwardly of said frame, disposing the four edges of a rigid four-sided board in said channel with said board edges substantially completely filling said channel, disposing a low density acoustical mat within the confines of said flanges of said frame four sides, and affixing a porous fabric facing under said acoustical mat and upward over the outer sides of said flanges and into said frame rebends, by crimping said rebends with the edges of said fabric disposed therewithin.

16. The method of claim 15 wherein said frame element is formed with a second rebend immediately above said channel and an upwardly directed flange is formed immediately above said rebend, indenting a fold line across said upper flange above said severance of said channel, disposing a second low density acoustical mat within the confines of said upper flanges of said frame four sides, and affixing a porous fabric facing over said acoustical mat and down over the outer sides of said upper flanges and into said upper rebends, by crimping said upper rebends with the edges of said upper fabric disposed therewithin.

* * * * *